US012492541B2

(12) United States Patent
Garcia

(10) Patent No.: US 12,492,541 B2
(45) Date of Patent: Dec. 9, 2025

(54) ANTI-SPLASH URINE GUARD NET FOR TOILET BOWLS

(71) Applicant: Leobardo Gudino Garcia, North Shore, CA (US)

(72) Inventor: Leobardo Gudino Garcia, North Shore, CA (US)

( * ) Notice: Subject to any disclaimer, the term of this patent is extended or adjusted under 35 U.S.C. 154(b) by 97 days.

(21) Appl. No.: 18/668,194

(22) Filed: May 19, 2024

(65) Prior Publication Data

US 2025/0354365 A1 Nov. 20, 2025

(51) Int. Cl.
*E03D 9/00* (2006.01)

(52) U.S. Cl.
CPC ..... *E03D 9/00* (2013.01)

(58) Field of Classification Search
CPC ..... E03D 9/00; A47K 17/00
See application file for complete search history.

(56) References Cited

U.S. PATENT DOCUMENTS 2,931,047 A * 4/1960 Stebbins ..... E03D 9/00 4/300.3
3,212,104 A * 10/1965 Stevens ..... E03D 9/00 4/300.3
4,062,070 A * 12/1977 Prince ..... E03D 9/00 4/300.3
4,215,443 A * 8/1980 Babik ..... A47K 17/00 4/300.3
5,930,847 A * 8/1999 Hall ..... E03D 9/00 4/300.3
6,385,784 B1 * 5/2002 Donohue ..... E03D 9/00 4/300.3
7,418,744 B2 * 9/2008 Smitherman ..... E03D 9/00 4/300.3
7,798,907 B2 * 9/2010 Piccionelli ..... A63F 9/0204 273/350
2012/0267856 A1 * 10/2012 Swan ..... E03D 9/005 273/348

* cited by examiner

*Primary Examiner* — Christine J Skubinna
(74) *Attorney, Agent, or Firm* — Sam Pierce

(57) ABSTRACT

According to an aspect of the present invention disclosed herein, there is provided an anti-splash urine guard net, comprising: a foam net; a toilet bowl; a toilet lid; a plurality of strings attaching the foam net to the toilet bowl; and a lever, wherein: the lever is connected to the foam net and the toilet lid; and the lever is configured so the foam net will rise when the toilet lid is opened and the foam net will drop when the toilet lid is closed.

10 Claims, 2 Drawing Sheets

ANTI-SPLASH URINE GUARD NET FOR TOILET BOWLS

BACKGROUND

The present invention is in the technical field of urine splash guards for toilet bowls. Males are particularly prone to missing the toilet bowl when urinating, and this can cause a frequent need to clean the toilet bowl surface outside the inside bowl and the surrounding floor and toilet seats and covers. The prior art patent literature includes a number of urine shields to address this unpleasant problem.

U.S. Pat. No. 8,856,976 discloses a urine shield comprising a unified single piece flexible plastic sheet with a width that are sufficient to permit the sheet to partly encircle the bowl of the toilet and compression-fitted to the inside of the bowl without any use of fixtures. The sheet includes a left portion having a bottom left end, a center portion, a right portion having a bottom right end. The sheet also comprises two flanges that slope outward from the bottom of the left portion and right portion with a length that decreases as the flange extends from the bottom end of each portion to the center portion. The flanges also extend at an angle less than perpendicular but more than parallel from the each portion. A method of using this urine shield is also provided.

U.S. Pat. No. 9,809,964 discloses a urine shield for a toilet is a collapsible splatter guard that is adapted for use with a toilet. The urine shield for a toilet attaches to the toilet between the toilet rim and the toilet seat. When extended, the urine shield for a toilet extends the enclosed space formed by the toilet bowl by creating a first U shaped structure. The purpose of the urine shield for toilet is to contain the random sprays and splashes of urination. The urine shield for a toilet retracts into a pair of housings that is attached to the toilet rim and mounted within the toilet bowl perimeter. The pair of housings contains a cleaning fluid that cleanses the first U shaped structure when the urine shield for a toilet is not in use. The urine shield for a toilet comprises a shield and a pair of housings.

Nevertheless, the prior art has disadvantages that prevents addressing the problem in a satisfactory manner, including lack of ease of use and lack of effectiveness.

SUMMARY OF INVENTION

Therefore, the present invention provides a foam net in combination with a lifting mechanism which raises the urine guard net from the bottom of the toilet bowl through the action of lifting a secondary toilet seat cover, and a lever.

According to an aspect of the present invention disclosed herein, there is provided an anti-splash urine guard net, comprising: a foam net; a toilet bowl; a toilet lid; a plurality of strings attaching the foam net to the toilet bowl; and a lever, wherein: the lever is connected to the foam net and the toilet lid; and the lever is configured so the foam net will rise when the toilet lid is opened and the foam net will drop when the toilet lid is closed.

DETAILED DESCRIPTION

Embodiments of the present invention will be described with reference to the following drawings.

Figure 1:
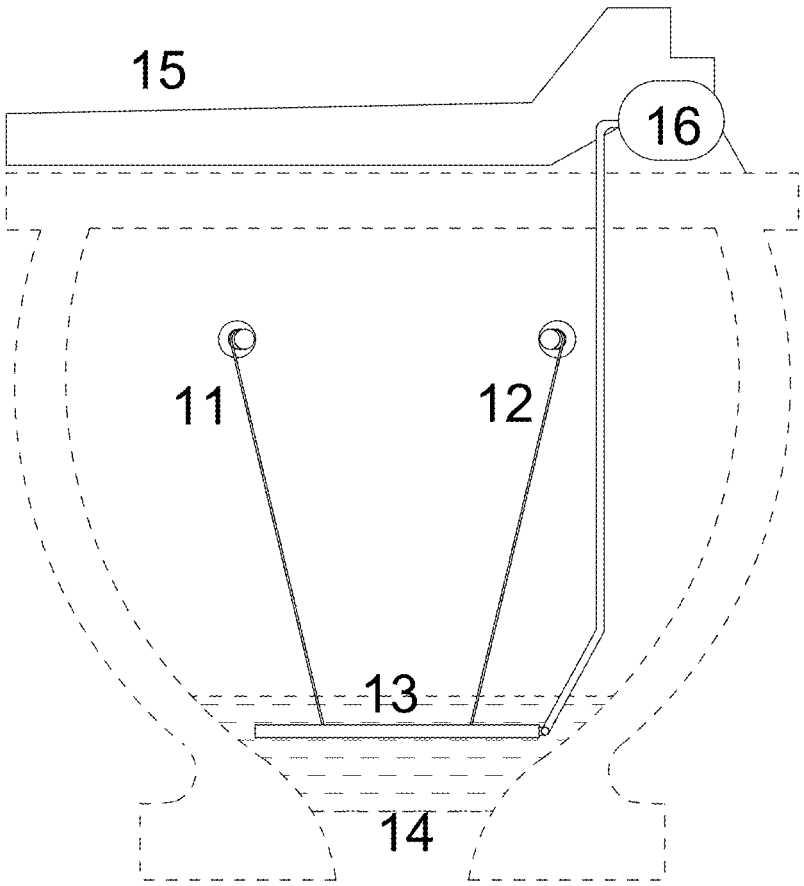
FIG. 1 is an illustration of the anti-splash urine guard net according to an embodiment the present invention with the toilet lid down.

FIG. 1 is an illustration of the anti-splash urine guard net according to an embodiment the present invention with the toilet lid down.

Net 13 is made of foam in a preferred embodiment. Foams are materials formed by trapping pockets of gas in a liquid or solid and are well-suited to serve as a net which can absorb errant urine. Net 13 is attached to strings 11 and 12. There may be a greater number of strings than two in some embodiments.

The net 13 in a preferred embodiment is crafted from a thin, foamy material, designed to securely adhere to the bottom of the toilet bowl when in its lowered position. In a preferred embodiment it features a design that covers approximately 80% of the bowl's interior, with a strategically placed hole in its center.

Additionally, the foam material of the net can be infused with a scent, which is activated upon absorption of urine and subsequent flushing, enhancing the bathroom experience and providing a pleasant odor to counteract unpleasant bathroom odors.

Toilet lid 15 is shown closed, i.e., covering the toilet bowl in the view of FIG. 1. When toilet lid 15 is closed, net 13 is positioned beneath the surface of toilet water 14.

Lever 16 connects the net 13 to the toilet lid 15 and is situated towards the rear of the toilet bowl. This lever 16 enables the net 13 to raise and lower when the lid 15 raises and lowers, and the net 13 will rise above the surface of the water 14 when the toilet lid 15 is opened and it will fall back to place beneath the surface when the toilet lid 15 is closed.

The strategic attachment of the strings at various angles within the bowl along with the connection of the net 13 to both the strings and the lever 16 and the lever's attachment to the lid 15 facilitate easy and efficient operation.

A mechanism that allows for vertical adjustment of the net height can also be provided. The mechanism can be windings for strings 11 and 12 attached to suction cups attaching strings 11 and 12 to the toilet bowl that allow for the strings to be adjusted in length so as to allow for the net height to be set as desired by the user.

Figure 2:
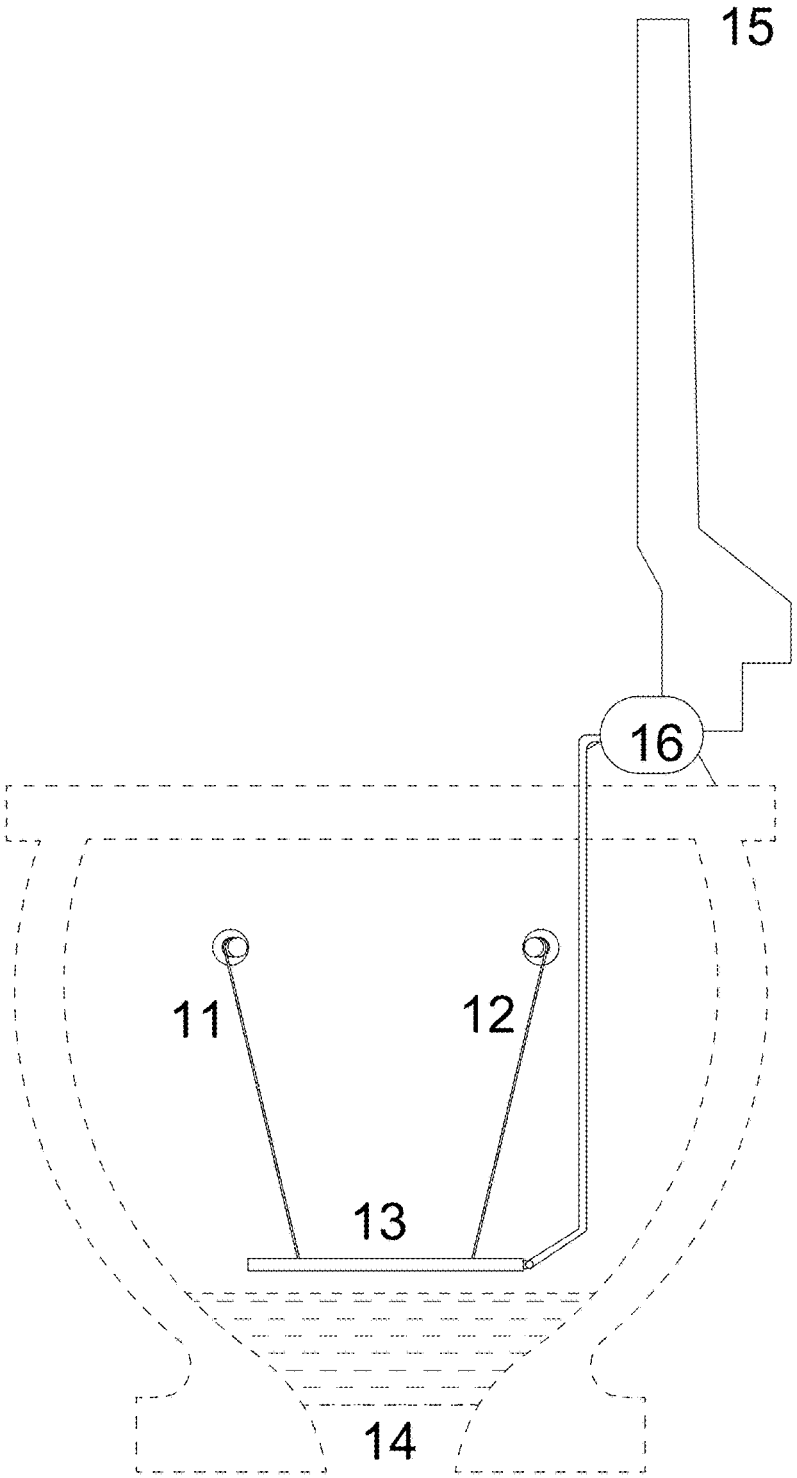
FIG. 2 is an illustration of the anti-splash urine guard net according to an embodiment the present invention with the toilet lid raised.

FIG. 2 is an illustration of the anti-splash urine guard net according to an embodiment the present invention with the toilet lid raised.

In the view of FIG. 2, the toilet lid 15 is shown opened. The lever 16 is configured so the net 13 has risen to slightly above the water surface 14 when the toilet lid 15 opened and the net 13 will drop beneath the water surface 14 when the toilet lid 15 is closed.

The strings 11 and 12 in a preferred embodiment are slender strings made of waterproof, waxed cotton, each terminating in a plastic suction cup that affixes to the interior of the toilet bowl for stability. Strings 11 and 12 can take on slack when the lever 16 is activated by the lifting of toilet bowl 15 and release the slack when the toilet bowl 15 is closed.

The illustrations of embodiments described herein are intended to provide a general understanding of the structure of various embodiments, and they are not intended to serve as a complete description of all the elements and features of apparatus and systems that might make use of the structures described herein. Other embodiments may be utilized and derived therefrom, such that structural and logical substitutions and changes may be made without departing from the scope of this disclosure.

Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Therefore, it is intended that the disclosure not be limited to the particular embodiment(s) disclosed.

In particular, the design of the urine guard net is highly adaptable, allowing it to assume various shapes to suit different toilet shapes and sizes, user preferences or other requirements. Similarly, the lever's appearance and operational mechanism can be customized to offer diverse functionalities. Additionally, the method by which the net ascends from the bottom of the toilet bowl can be implemented through multiple techniques. The attachment method of the urine guard net to either the suction cups and/or the lever also offers flexibility, enabling alternative approaches to its installation and use.

Figures are also merely representational and may not be drawn to scale. Certain proportions thereof may be exaggerated, while others may be minimized. Accordingly, the specification and drawings are to be regarded in an illustrative rather than a restrictive sense.

What is claimed is:

1. An anti-splash urine guard net, comprising:

a net;

a toilet bowl;

a toilet lid;

a plurality of strings attaching the net to the toilet bowl; and a lever, wherein:

the lever is connected to the net and the toilet lid; and the lever is configured so the net will rise when the toilet lid is opened and the net will drop when the toilet lid is closed.

2. The anti-splash urine guard net of claim 1, wherein the net is a foam net.

3. The anti-splash urine guard net of claim 1, wherein the lever is positioned at the back of the toilet bowl.

4. The anti-splash urine guard net of claim 1, wherein the plurality of strings are attached to the toilet bowl by suction cups.

5. The anti-splash urine guard net of claim 4, further comprising a mechanism that allows for vertical adjustment of the net height.

6. The anti-splash urine guard net of claim 5, wherein the mechanism that allows for vertical adjustment of the net height is a spool and windings on the suctions cups.

7. The anti-splash urine guard net of claim 1, wherein the lever is configured so the net will rise to slightly above the water surface when the toilet lid is opened and the net will drop beneath the water surface when the toilet lid is closed.

8. The anti-splash urine guard net of claim 2, wherein the foam net is infused with a scent.

9. The anti-splash urine guard net of claim 8, wherein the scent is activated upon absorption of urine and subsequent flushing.

10. The anti-splash urine guard net of claim 1, wherein the number of strings is 2 to 6.

* * * * *